United States Patent [19]

McKay et al.

[11] 4,300,526

[45] Nov. 17, 1981

[54] WOODBURNING STOVE

[76] Inventors: John McKay; Billy C. Hawkins, both of 41 Hampton Arms, Greenville, S.C. 29601

[21] Appl. No.: 116,571

[22] Filed: Jan. 29, 1980

[51] Int. Cl.[3] ..... F24B 3/00; F24C 1/14; F24C 15/28; F24B 7/00

[52] U.S. Cl. ..... 126/67; 126/77; 126/83; 126/121

[58] Field of Search ..... 126/77, 63, 121, 61, 126/66, 58, 83, 67

[56] References Cited

U.S. PATENT DOCUMENTS

| | | | |
|---|---|---|---|
| 1,697,371 | 1/1929 | Sala | 126/121 |
| 4,074,679 | 2/1978 | Jensen | 126/121 |
| 4,177,791 | 12/1979 | Marchant | 126/77 |
| 4,185,610 | 1/1980 | Buckner | 126/63 |
| 4,185,612 | 1/1980 | Briner | 126/121 |
| 4,196,713 | 4/1980 | Blankenship et al. | 126/77 |
| 4,204,517 | 5/1980 | Rumsey | 126/83 |

*Primary Examiner*—Albert W. Davis
*Assistant Examiner*—Wesley S. Ratliff, Jr.
*Attorney, Agent, or Firm*—Bailey, Dority & Flint

[57] ABSTRACT

A woodburning stove having an inner housing and an outer housing spaced therefrom providing air passages therebetween. A blower circulates air through the air passages for absorbing heat from the walls of the housing and exhausting the heated air into the room where the stove is located. A substantially horizontal plate is spaced below the top wall of the inner housing defining an afterburner space. A duct extends between the passages extending between the two housings and the afterburner space. The duct is provided with a valve so that fresh air can be controllably applied to the afterburner space for causing combustion of gasses flowing through the afterburner space. A fresh air duct extends along the side of the stove and connects with the blower for supplying fresh air from the front of the stove to the blower.

2 Claims, 5 Drawing Figures

WOODBURNING STOVE

BACKGROUND OF THE INVENTION

Woodburning stoves have become very popular in recent years especially to supplement heating of homes that have normally been heated with gas and oil. Throughout the specification and claims, the term woodburning stove will be utilized, however, it is to be understood that any type of fuel such as wood or coal, could be burned in the stove. One such stove is illustrated in U.S. Pat. No. 4,092,976.

Woodburning stoves presently on the market are often constructed utilizing inner and outer housings with a space provided between the housings through which air is blown for absorbing heat from the walls of the stove. The stoves are often equipped with a horizontally extending plate which is positioned below the top surface of the inner housing. This place causes the gases being expelled by the fire in the stove to take a substantially S-shaped path, increasing the efficiency of the stove by possibly igniting as they pass between the top of the inner housing and the horizontal plate. One problem in causing combustion in these gases is lack of oxygen or fresh air.

SUMMARY OF THE INVENTION

In accordance with the present invention, it has been found that if preheated fresh air is supplied to the space provided between a horizontal plate positioned below the top inner housing and the top of the inner housing, the efficiency of combustion of gases flowing through this afterburner section increases.

In accordance with the present invention, a woodburning stove is constructed having an inner housing and an outer housing spaced therefrom providing air passages therebetween. A blower circulates air through the air passages for absorbing heat from the walls of the housing and exhausting heated air into the room where the stove is located. A chimney opening is provided in the top of the inner and outer housing adjacent a rear portion of the stove. A substantially horizontally extending plate is spaced vertically below the top wall of the inner housing with a rear edge of the plate being joined to the top wall and a forward edge of the plate terminating short of the front of the stove producing an afterburner space for gases flowing from a fire built in the stove to the chimney opening. A duct provides communication between the air passage and the afterburner space. A valve is carried within the duct controlling the flow of preheated air from the passage through the duct to the afterburner space for causing combustion of gases flowing through the afterburner space. A fresh air duct extends from the blower along a side wall of the stove and terminates adjacent the front of the stove for supplying air to the blower from the room being heated. Vanes are carried between the walls of the inner and outer housings for controlling the flow of air therebetween.

Accordingly, it is an important object of the present invention to provide a woodburning stove with an afterburning section and supplying fresh air thereto for causing efficient combustion.

Another important object of the present invention is to provide an efficient woodburning stove.

Still another important object of the present invention is to provide a woodburning stove which can be inserted within a recessed fireplace which removes air from the room being heated and circulates the air through passages provided between the inner and outer walls of the stove for heating the air.

These and other objects and advantages of the invention will become apparent upon reference to the following specification, attendant claims and drawings.

DESCRIPTION OF A PREFERRED EMBODIMENT

Figure 1:
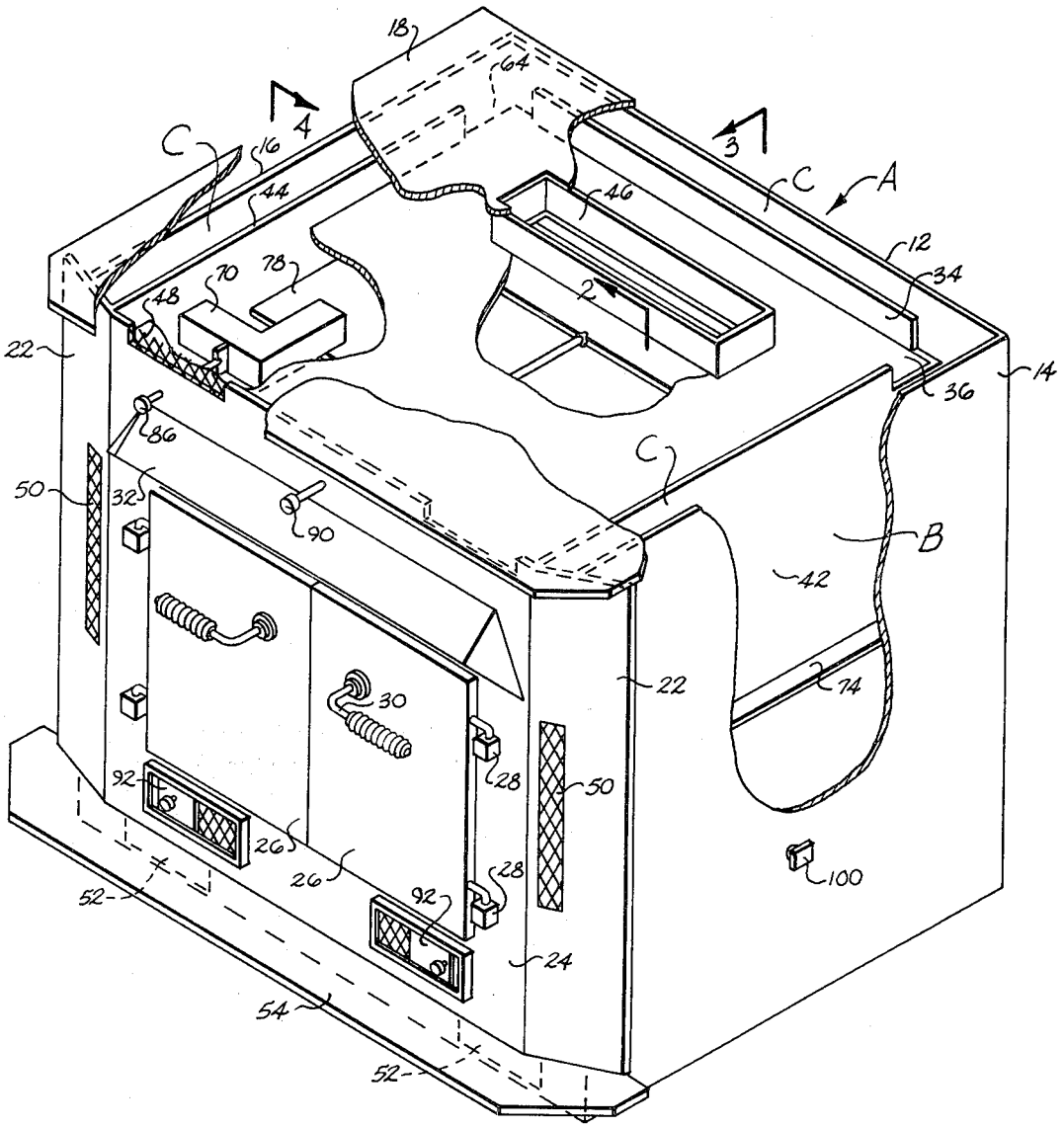
FIG. 1 is a front perspective view with parts broken away illustrating a woodburning stove constructed in accordance with the present invention.

Referring in more detail to the drawings, there is illustrated a woodburning stove constructed in accordance with the present invention which includes an outer housing generally designated by the reference character A, and an inner housing B. The outer housing includes a rear wall 12 that is joined to side walls 14 and 16. Positioned on the top of the side walls 14 and 16 is a top 18 and on the bottom is a bottom 20.

A front wall includes inclined panels 22 having a substantially planar front face 24 interposed therebetween. Doors 26 are connected by hinges 28 to the front panel 24. Handles 30 are provided on the doors and are equipped with latches (not shown) for latching the doors closed. Positioned directly above the doors 26 is an outwardly extending hood 32.

The inner housing B includes a rear wall 34, a top wall 36, a bottom wall 38, and side walls 42 and 44. The walls of the inner housing are spaced from the walls of the outer housing providing air passages C positioned therebetween. As can be seen in more detail in FIGS. 2-5, the air passages allow air to flow over the top, sides and bottom of the inner housing.

A chimney 46 extends through the top of the inner and outer housing for allowing exhaust gases to flow from the interior of the firebox. Vents 48 are provided in the front wall of the stove through which heated air is exhausted after passing between the tops of the inner and outer housings A and B. Vents 50 are provided in the panel 22 through which heated air is exhausted after it passes between the side walls of the housings A and B. Vents 52 located in the front wall directly below the outwardly extending hearth 54 are provided for exhausting heated air after it passes between the bottoms of the inner and outer housings.

A hole 56 is provided in the rear wall 12 and a blower 58 is mounted on the rear wall for forcing air through the opening 56 into the passage extending between the rear walls 34 and 12. Vanes 60 and 62 are carried on the rear wall 34 of the inner housing for directing air from the blower to the various passages C. The horizontally extending vane causes approximately one-third of the air to flow downwardly to pass through the passage between the bottoms of the inner and outer housings and the side walls. The vanes 60 direct the air to the passages C between the side walls and also to openings 64 into the passage provided between the top walls of the inner and outer housings.

Figure 4:
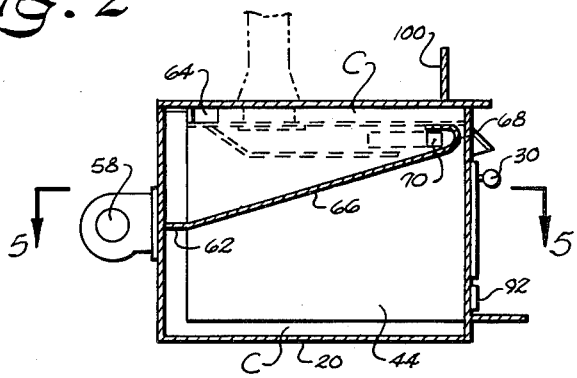
FIG. 4 is a sectional view taken along line 4—4 of FIG. 1.

As shown in FIG. 4, an inclined vane 66 extends from the vane 62 upwardly along the side of the wall 44 and terminates in an arcuate end portion 68 for directing the air flowing thereabove into one end of a duct 70.

A V-shaped vane 72 is carried between the top walls 36 and 16 of the inner and outer housing. On the outer side 42 of the inner housing there is a single horizontally extending vane 74. All the vanes are provided for conveying the air towards the exhaust vent located in the front walls of the stove, with the exception of the vane 66.

Figure 2:
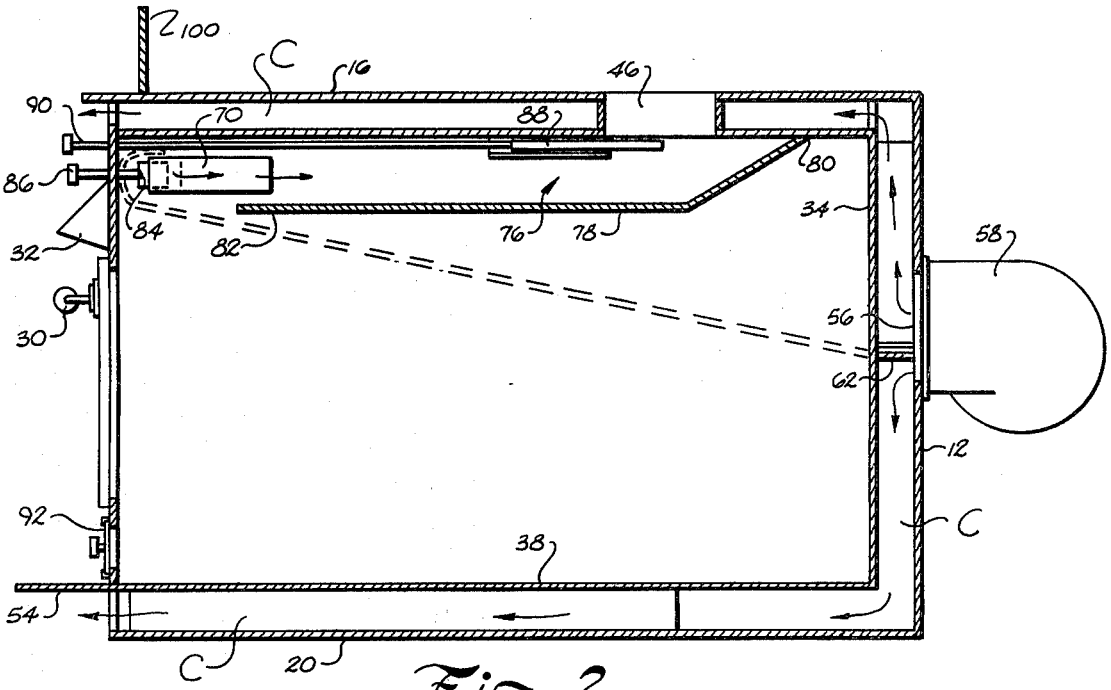
FIG. 2 is a sectional view taken along line 2—2 of FIG. 1.
Figure 3:
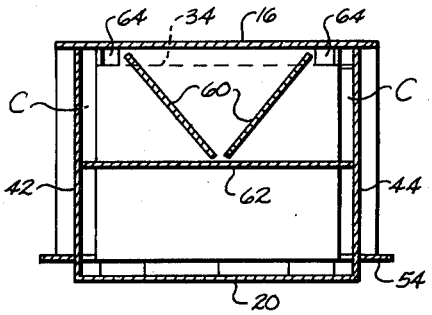
FIG. 3 is a sectional view taken along line 3—3 of FIG. 1.

The duct 70 is substantially L-shaped with one end communicating with the passage C extending between the side walls 44 and 16 and the other end terminating in an afterburner space, generally designated by the reference character 76 as shown in FIG. 2. The afterburner space 76 is formed by a substantially horizontally extending plate 78 which is spaced below the top wall 36 of the inner housing. A rear edge 80 of the plate 78 is secured to the wall 36 and a forward edge 82 of the plate 78 terminates short of the front wall of the stove. The plate 78 extends between the side walls 42 and 48 of the inner housing.

As a result of the plate 78, when a fire is ignited in the firebox of the stove which consists of the inner housing, exhaust gases flow upwardly and around the forward edge 82 of the plate 78 and through the afterburner space 76 and out of the chimney 46. Such is commonly referred to as an S-shape flow pattern for the exhaust gases.

In order to allow the gases flowing through the afterburner space 76 to have efficient combustion, preheated air is forced through the dogleg shaped duct 70 into the afterburner space. This increases the efficiency of the combustion taking place in the afterburner space. A valve 84 connected to an outwardly extending rod 86 is provided for controlling the forced air through the duct 70. Since the air entering the duct 70 has previously passed through the passage C along the side wall of the stove, it is preheated for aiding in the combustion of the gases in the afterburner passage.

A damper plate 88 is positioned below the chimney 46 and can be manipulated by means of a rod 90 for varying the size of the opening through the chimney.

Slidable dampers 92 are also provided in the lower portion of the front wall of the stove.

Figure 5:
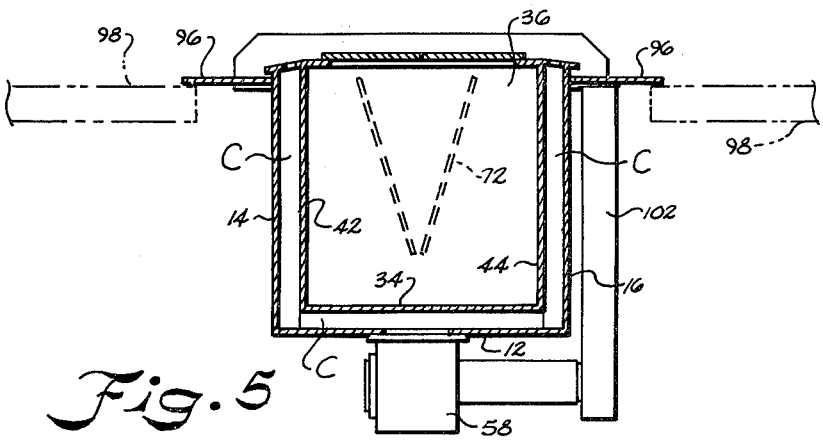
FIG. 5 is a sectional view along line 5—5 of FIG. 4.

The particular model of the stove shown in the drawings, is adapted for being inserted in a recessed fireplace, such as illustrated in FIG. 5. Extensions 96 extend out from the side walls of the stove for producing a substantial seal between the stove and walls 98 forming part of the fireplace. A similar extension 100 is carried on top of the stove for producing a seal between the top of the stove and the fireplace.

An opening is provided in the front of one of the extensions 96 for receiving fresh air from the room being heated and being drawn through a fresh air duct 102 along the side of the stove by the blower 58.

A thermostat 110 is provided in the outer wall 14 of the outer housing and extends into the passage C for sensing the temperature of the air therein. When the temperature reaches a predetermined level the blower is turned on under control of the thermostat 100.

While a preferred embodiment of the invention has been described using specific terms, such description is for illustrative purposes only, and it is to be understood that changes and variations may be made without departing from the spirit or scope of the following claims.

What is claimed is:

1. A woodburning stove having an inner housing and an outer housing spaced therefrom providing air passages therebetween, a blower circulating air through said air passages for absorbing heat from the walls of said housings and exhausting the heated air into the room where said stove is located, a chimney opening provided in the top of said inner and outer housings adjacent a rear portion of said stove, a substantially horizontally extending plate spaced vertically below the top wall of said inner housing, a rear edge of said plate being joined to said top wall of said inner housing and a forward edge of said plate terminating short of the front of said stove producing an afterburner space for gases flowing from a fire built in said stove to said chimney opening, the improvement comprising:

a duct providing communication between said air passage and said after burner space; and valve means for controlling the flow of preheated air from said passage through said duct to said afterburner space for causing combustion of said gases flowing through said afterburner space.

2. The woodburning stove as set forth in claim 1 further comprising:

a vane means extending between a side wall of said inner housing and said outer housing terminating in an arcuate end portion for directing preheated air to said duct.

* * * * *